US008403897B2

(12) United States Patent
Hayes

(10) Patent No.: US 8,403,897 B2
(45) Date of Patent: Mar. 26, 2013

(54) BIODEGRADABLE BACK AND BODY STRAP

(76) Inventor: Michael A. Hayes, West Geelong (AU)

( * ) Notice: Subject to any disclaimer, the term of this patent is extended or adjusted under 35 U.S.C. 154(b) by 165 days.

(21) Appl. No.: 12/772,283

(22) Filed: May 3, 2010

(65) Prior Publication Data

US 2010/0305520 A1 Dec. 2, 2010

(51) Int. Cl.
*A61M 35/00* (2006.01)
*A47K 7/03* (2006.01)

(52) U.S. Cl. ..... 604/289; 604/290; 401/8; 401/6; 15/222

(58) Field of Classification Search ..... 15/222; 428/76; 604/289, 290
See application file for complete search history.

(56) References Cited

U.S. PATENT DOCUMENTS 1,379,925 A * 5/1921 Kawasaki ..... 15/222
1,488,332 A * 3/1924 Foerg ..... 15/210.1
1,741,962 A * 12/1929 Theodoropulos ..... 15/222
1,823,689 A * 9/1931 Kelley ..... 15/210.1
2,008,990 A * 7/1935 Mullen ..... 15/222
2,807,815 A * 10/1957 Mack ..... 15/118
3,061,841 A * 11/1962 Johnson ..... 4/615
3,720,205 A * 3/1973 Liebman ..... 601/143
4,187,575 A * 2/1980 Collins ..... 15/222
4,422,205 A * 12/1983 Braxter, Sr. ..... 15/222
4,512,054 A * 4/1985 Clark ..... 15/222
4,672,707 A * 6/1987 Johnson ..... 15/222
4,759,652 A * 7/1988 Ulrich ..... 401/196
5,035,523 A 7/1991 Allinder
5,251,990 A * 10/1993 Vought et al. ..... 401/8
5,386,609 A * 2/1995 Xenos ..... 15/222
D381,545 S * 7/1997 Muttick et al. ..... D6/608
5,664,281 A * 9/1997 Pelfrey ..... 15/244.2
5,671,498 A * 9/1997 Martin et al. ..... 15/244.3
5,736,213 A * 4/1998 Meier ..... 428/76
5,979,006 A * 11/1999 Stokes et al. ..... 15/222
5,983,436 A * 11/1999 Mason et al. ..... 15/222
6,026,531 A * 2/2000 Pruitt ..... 15/160
6,386,776 B2 5/2002 Scariano
6,786,666 B1 9/2004 Floyd-Williams et al.
6,849,055 B1 2/2005 Williams
6,969,362 B2 * 11/2005 Wang ..... 601/137
7,661,897 B1 * 2/2010 Jackson ..... 401/6
2006/0248672 A1 * 11/2006 Dussaussoy ..... 15/222

* cited by examiner

*Primary Examiner* — Susan Su

(57) ABSTRACT

A unitary biodegradable, absorbent flexible back and body strap for selectively applying a protective substance and a skin-protective agent to a user's body, the strap having an elongated thin parallelepiped midportion, a biconcave first gripping end, and an opposite biconcave second gripping end, each end having a tip narrower in width than the midportion. The midportion is impregnated with a protective substance, which may be a body lotion, sunscreen, insect repellant, or a combination of sunscreen and insect repellant. At least one protective agent layer may be disposed on a midportion top side, which contains a skin-protective agent. The user alternatingly pulls the first gripping end and the second end from side to side across the desired body portion to selectively apply the protective substance and the skin-protective agent discards the strap whereinafter the strap biodegrades.

7 Claims, 3 Drawing Sheets

BIODEGRADABLE BACK AND BODY STRAP

CROSS-REFERENCE TO RELATED APPLICATIONS

Australian Provisional Application No. 2009902480 filed on Jun. 1, 2009

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

People who are outdoors in the sun for prolonged periods of time are often exposed to the damaging effects of ultraviolet radiation and dryness of the skin. This is especially so for people who work outdoors or are involved daily in outdoor sports. Dry skin can become itchy and, if exposed to excessive sunlight, can burn and then blister and peel.

Skin cancers, like melanoma, may result from excessive exposure of unprotected skin to sunlight. For people who do not choose to wear protective clothing, sunscreen can be applied to exposed skin, but this can be a problem because, if there is no one to apply the sunscreen to the person's back, the person may find it hard to reach their back. Skin moisturizer may also sometimes need to be applied to the body, such as after showering or bathing with soap, and this too may be difficult for a person to apply to his back or other portions of his body. The same problem applies to the application of insect repellent to the back or other body portions.

Straps for rubbing, cleaning and exfoliating the back during showering are known, but these can, at most, have soap or other cleansing agent applied to them during the showering. They do not have a cleansing agent impregnated into the strap for slow release when rubbing contact is made with the back. Also, such straps may be made of a non-biodegradable plastic or other material, and so will present a long term pollution problem when they are discarded. It has been found by the present inventor that these problems can be overcome by providing a biodegradable back and body strap that is impregnated with a substance that can be applied by a person on their body, and including to the back, who is holding the device between both hands and is rubbing it against the body from side to side.

FIELD OF THE INVENTION

The present invention relates to a back and body strap that is impregnated with a substance that can be rubbed on the body, and particularly to the back, and is biodegradable.

SUMMARY OF THE INVENTION

The general purpose of the present, described subsequently in greater detail, is to provide a which has many novel features that result in a which is not anticipated, rendered obvious, suggested, or even implied by prior art, either alone or in combination thereof.

To accomplish this, the present back and body strap includes an elongated body having a first cut out portion at one end adapted to be gripped by one hand of a user and a second cut out portion at the other end adapted to be gripped by the other hand, the body being formed of a biodegradable and absorbent material impregnated with a substance for application to the body of the user.

According to another aspect of the present invention, there is provided a dispenser for the biodegradable back and body straps defined above, the dispenser being substantially air-tight and containing a reservoir of substance to maintain a sufficient concentration of impregnated substance in the absorbent material, and having a sealable opening for dispensing individual ones of the straps at anyone time.

Preferably, the substance is selected from the group consisting of a liquid, lotion or cream. In a preferred form; the substance is a sunscreen lotion. Alternatively, the substance is a moisturizing cream. In yet another embodiment, the substance is an insect repellent liquid, a cleansing liquid, or a perfumed liquid.

Thus has been broadly outlined the more important features of the present and method so that the detailed description thereof that follows may be better understood and in order that the present contribution to the art may be better appreciated.

Numerous objects, features and advantages of the present biodegradable back and body strap will be readily apparent to those of ordinary skill in the art upon reading the following detailed description of presently preferred, but nonetheless illustrative, examples of the present biodegradable back and body strap when taken in conjunction with the accompanying drawings. In this respect, before explaining the current examples of the present biodegradable back and body strap in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the and method. It is therefore important that the claims be regarded as including such equivalent constructions insofar as they do not depart from the spirit and scope of the present invention.

Objects of the present biodegradable back and body strap, along with various novel features that characterize the invention are particularly pointed out in the claims forming a part of this disclosure. For better understanding of the present back and body strap, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
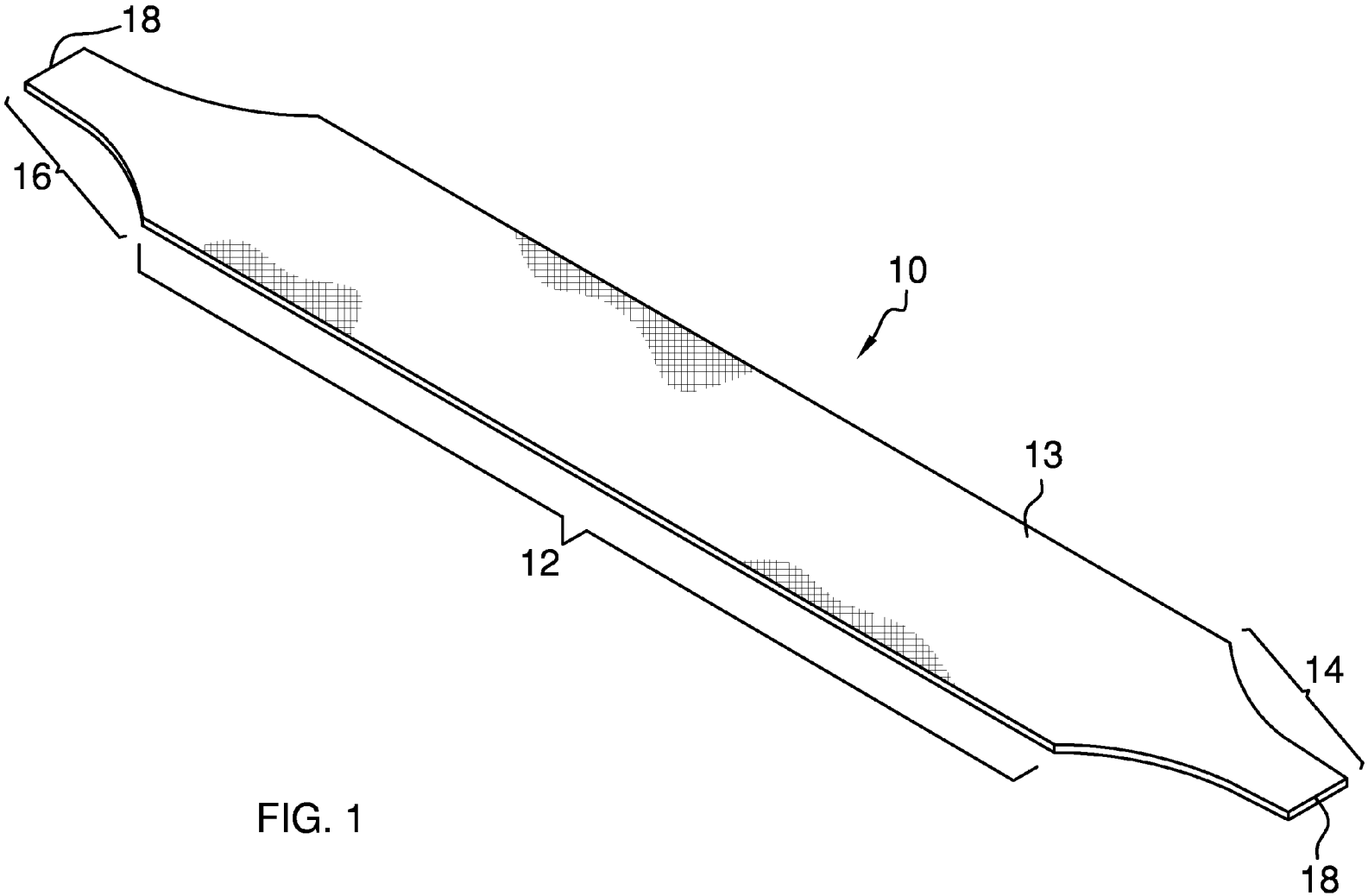
FIG. 1 is an isometric view.
Figure 2:
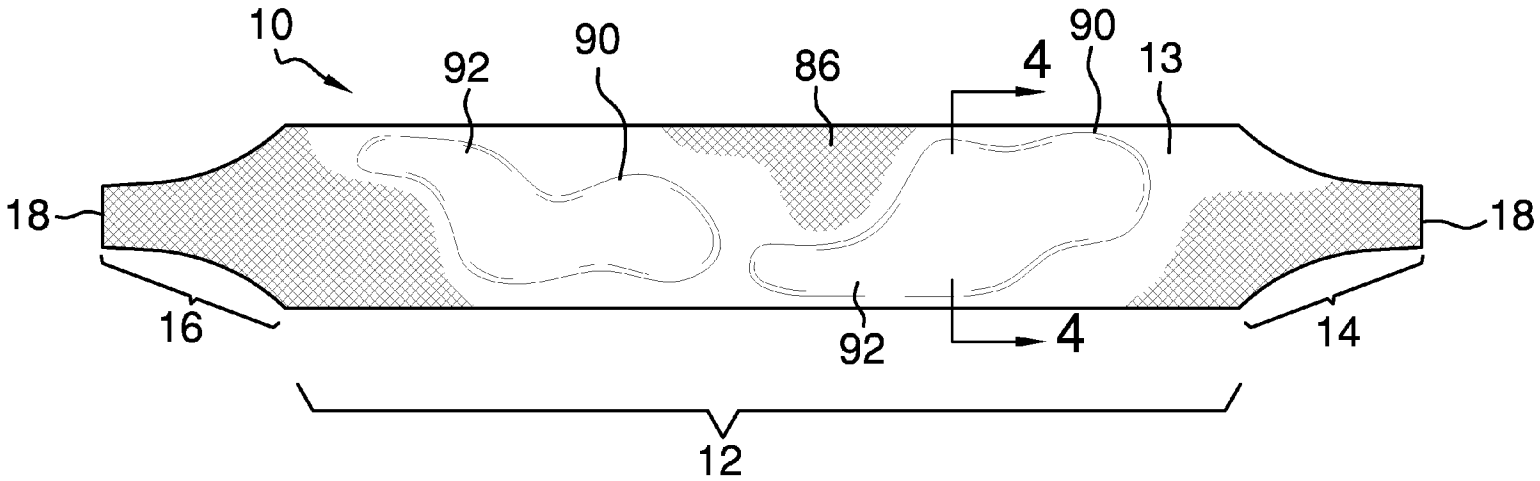
FIG. 2 is a top plan view.
Figure 3:
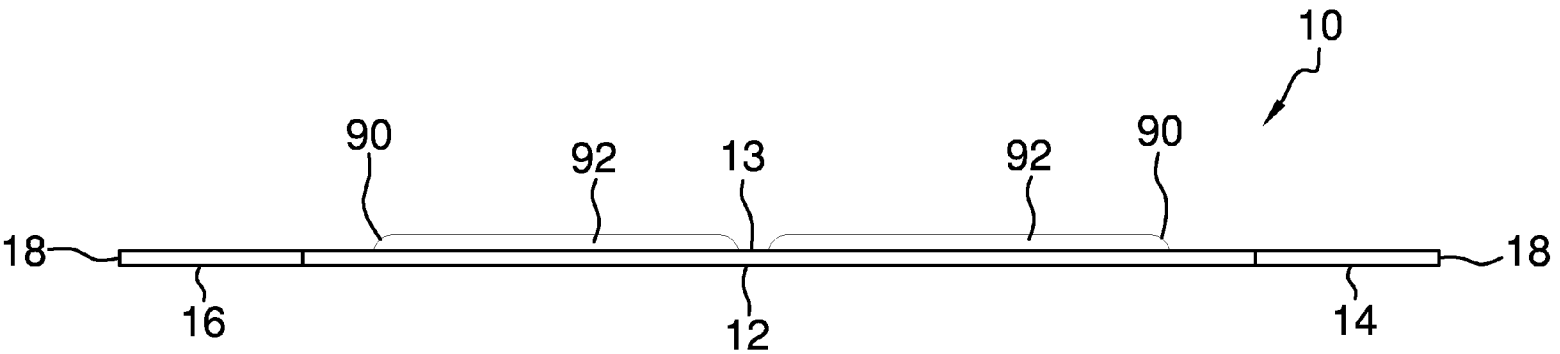
FIG. 3 is a side elevation view.
Figure 4:
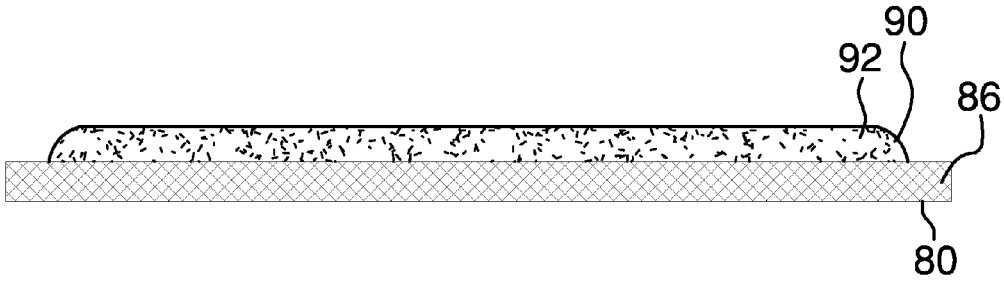
FIG. 4 is a cross-section view taken along line 4-4 of FIG. 2.
Figure 5:
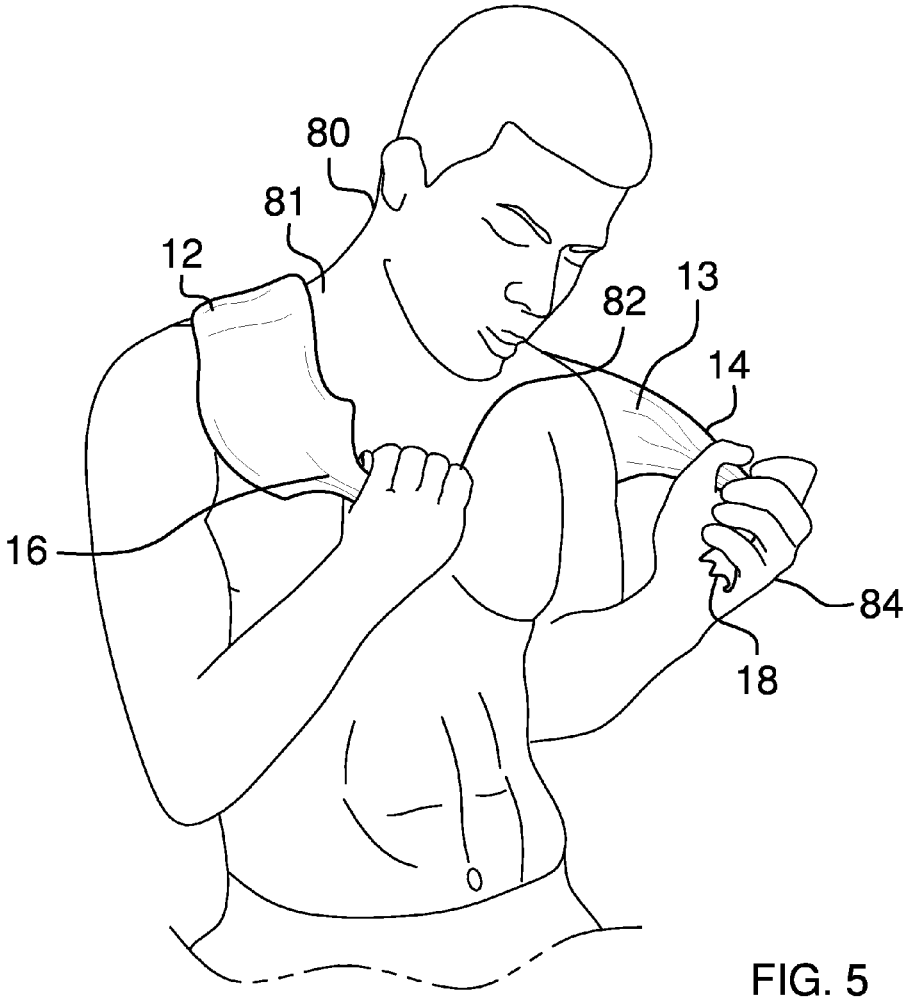
FIG. 5 is an in-use view.

With reference now to the drawings, and in particular FIGS. 1 through 5 thereof, example of the instant employing the principles and concepts of the present and generally designated by the reference number 10 will be described.

Referring to FIGS. 1 through 5 a preferred embodiment of the present biodegradable back and body strap 10 is illustrated. The biodegradable back and body strap 10 is a flexible unitary body which includes an elongated thin parallelepiped midportion 12, a biconcave first gripping end 14, and an opposite biconcave second gripping end 16 identical to the first gripping end 14. The term "unitary", as used throughout this specification, is taken to mean a singular body requiring no detachable parts. Each of the first gripping end 14 and the second griping end 16 has a straight-edged tip 18 which is narrower in width than the midportion 12 width. The tip 18 has a width about one-half the width of the midportion 12 width. Each of the first gripping end 14 and the second gripping end 16 is removably gripped by an opposite hand 82, 84 of a user 80. The biconcave shape of each of the first gripping end 14 and second gripping end 16 is critical in that the biconcave shape is more easily gripped by a user's 80 hands 82, 84 than a rectangular shape, a plano-concave shape, or other shape.

The midportion 12 is impregnated with a protective substance 86, which may include a liquid, lotion, or cream, such as sunscreen, insect repellant, a combination of both sunscreen and insect repellant, or a body lotion. The impregnation of the midportion 12 with the protective substance 86 allows for slow release of the agent onto a user's 80 body 81.

The midportion 12 may also include at least one protective-agent layer 90 disposed on a top side 13 of the midportion 12. The protective-agent layer 90 contains a skin-protective agent 92, which may be skin moisturizer or sunscreen. The midportion 12 defines an application region wherein the midportion 12 applies the skin-protective agent 92 contained within the protective-agent layer 90 to a user's body 80.

The present back and body strap 10 is formed of a biodegradable, absorbent material which may be cotton or other plant derivative. Soft leather or other animal derivative may also be used to form the strap 10. The sunscreen preferably has an SPF of 30+, although the SPF may vary according to the user's needs. The back and body strap 10 is flexible and can be easily scrunched together.

Use:

To use the present biodegradable back and body strap 10, a user 80 places the midportion 12 against the user's 80 body 81 where the user 80 desires to apply either the protective substance 86 or the skin-protective agent 92 or a combination of both. The user 80 grips the first gripping end 14 and the second gripping end 16 with an opposite one of the user's 80 hands 82, 84. The user 80 then alternatingly pulls the first gripping end 14 and the second gripping end 16 from side to side across the body 81 portion. The user 80 initiates the application process by placing pressure against the midportion 12 whereby the protective substance 86 and the skin-protective agent 92 are selectively released from the protective-agent layer 90 and midportion 12 onto the user's 80 body 81. When the user 80 has completed the application process, the user 80 discards the present biodegradable back and body strap 10 whereinafter the strap 10 biodegrades.

With respect to the above description then, it is to be realized that the optimum dimensional relationships for the parts of the present biodegradable body and body strap 10 to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A biodegradable back and body strap for applying protective substances and skin-protective agents to a user's body, the strap comprising:

at least one protective-agent layer containing a skin-protective agent;

a flexible unitary body consisting of:

an elongated thin parallelepiped midportion impregnated with a protective substance separate from said skin-protective agent;

a first cut out portion in the body forming a biconcave first gripping end;

a second cut out portion in the body forming an opposite biconcave second gripping end identical to the first gripping end;

a straight-edged tip disposed on each of the first gripping end and the second gripping end, the tip having a width narrower than the midportion width;

wherein the body is formed of an absorbent, biodegradable material;

wherein each of the first gripping end and the second gripping end can be removably gripped by an opposite hand of a user;

wherein the protective substance is slowly released onto the user's body.

2. The biodegradable back and body strap of claim 1, wherein the at least one protective-agent layer is disposed on a top side of the midportion.

3. The biodegradable back and body strap of claim 2, wherein the protective substance is selected from the group consisting of sunscreen, insect repellant, a body lotion, and a combination of both sunscreen and insect repellant.

4. The biodegradable back and body strap of claim 1, wherein the skin-protective agent is selected from the group consisting of skin moisturizer and sunscreen.

5. The biodegradable back and body strap of claim 4 wherein the tip has a width about one-half the width of the midportion width.

6. The biodegradable back and body strap of claim 5 wherein the biodegradable, absorbent material is cotton.

7. A method of using the biodegradable back and body strap of claim 6, the method comprising:

placing the midportion against a portion of a user's body;

gripping the first gripping end and the second gripping end with an opposite one of the user's hands;

alternatingly pulling the first gripping end and the second gripping end from side to side across a portion of the user's body;

placing pressure against the midportion whereby the protective substance and the skin-protective agent are selectively released from the protective-agent layer and midportion onto the user's body; and discarding the strap whereinafter the strap biodegrades.

* * * * *